US005473827A

United States Patent [19]

Barre et al.

[11] Patent Number: 5,473,827

[45] Date of Patent: Dec. 12, 1995

[54] OUTSOLE FOR SPORTS SHOES

[75] Inventors: Jean-Gabriel Barre; Jean-Pierre Branger, both of Pouzauges, France

[73] Assignee: Patrick International, France

[21] Appl. No.: 207,233

[22] Filed: Mar. 7, 1994

Related U.S. Application Data

[63] Continuation of Ser. No. 947,932, Sep. 21, 1992, abandoned.

[30] Foreign Application Priority Data

Sep. 19, 1991 [FR] France ..... 91 11574

[51] Int. Cl.[6] ..... A43B 5/00; A43B 13/14; A43B 5/02; A43B 23/28

[52] U.S. Cl. ..... 36/134; 36/31; 36/128; 36/59 R

[58] Field of Search ..... 36/29, 61, 62, 36/59 R, 59 B, 59 C, 127, 128, 134, 11.5, 31, 76 R, 134, 126, 67 D

[56] References Cited

U.S. PATENT DOCUMENTS

| | | | |
|---|---|---|---|
| 1,545,746 | 7/1925 | De Groot | 36/126 X |
| 1,633,324 | 6/1927 | Hartung | 36/36 R |
| 2,101,761 | 12/1937 | Stagl | 36/59 A X |
| 2,367,736 | 1/1945 | Parsons | 36/62 |
| 2,669,036 | 2/1954 | Israel | 36/11.5 |
| 3,341,952 | 9/1967 | Dassler | 36/134 X |
| 4,316,334 | 2/1982 | Hunt | 36/75 R |
| 4,392,312 | 7/1983 | Crowley et al. | 36/59 R X |
| 4,454,662 | 6/1984 | Stubblefield | 36/134 X |
| 4,543,222 | 9/1985 | Ehrlich | 36/11.5 X |
| 4,658,516 | 4/1987 | Beck | 36/59 B |
| 4,787,156 | 11/1988 | Bade | 36/128 |
| 4,833,796 | 5/1989 | Flemming | 36/134 |
| 4,858,343 | 8/1989 | Flemming | 36/128 |
| 4,897,936 | 2/1990 | Fuerst | 36/59 R X |
| 5,077,916 | 1/1992 | Beneteau | 36/31 X |

FOREIGN PATENT DOCUMENTS

| | | | |
|---|---|---|---|
| 229876 | 9/1959 | Australia | 36/128 |
| 2161573 | 6/1973 | Germany | 36/59 R |
| 3219652 | 12/1983 | Germany | 36/128 |
| 3706069 | 9/1988 | Germany . | |
| 867015 | 5/1961 | United Kingdom | 36/127 |
| 1379060 | 1/1975 | United Kingdom . | |
| 2020161 | 11/1979 | United Kingdom | 36/59 R |

*Primary Examiner*—Steven N. Meyers
*Assistant Examiner*—Beth Anne C. Cicconi
*Attorney, Agent, or Firm*—Poms, Smith, Lande & Rose

[57] ABSTRACT

The outsole comprises rigid plates in plastic material which plates are bonded to a sole body in an abrasion-resistant plastic material, projections such as studs being joined to the plates and dampening cushions traversing the sole body and extending between the plates.

23 Claims, 5 Drawing Sheets

FIG. 3
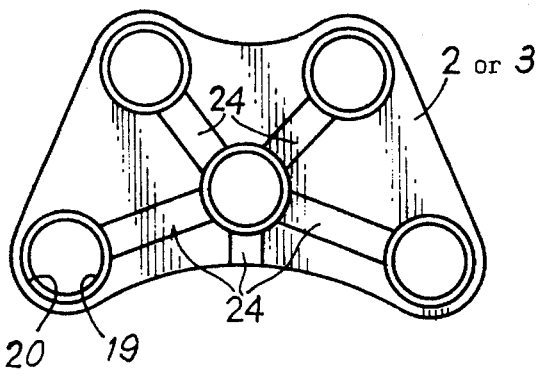
FIG. 4
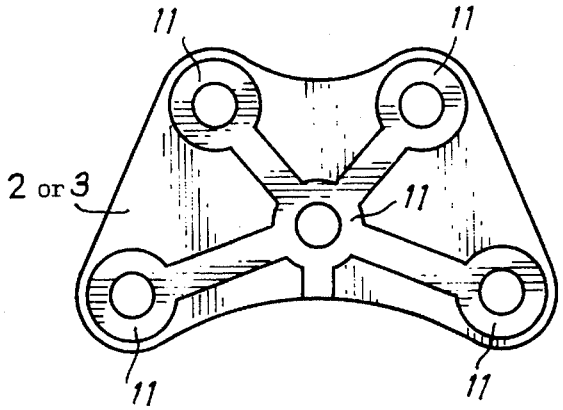
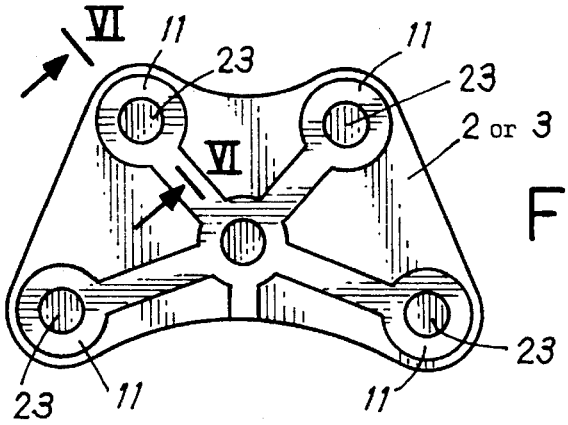
FIG. 5
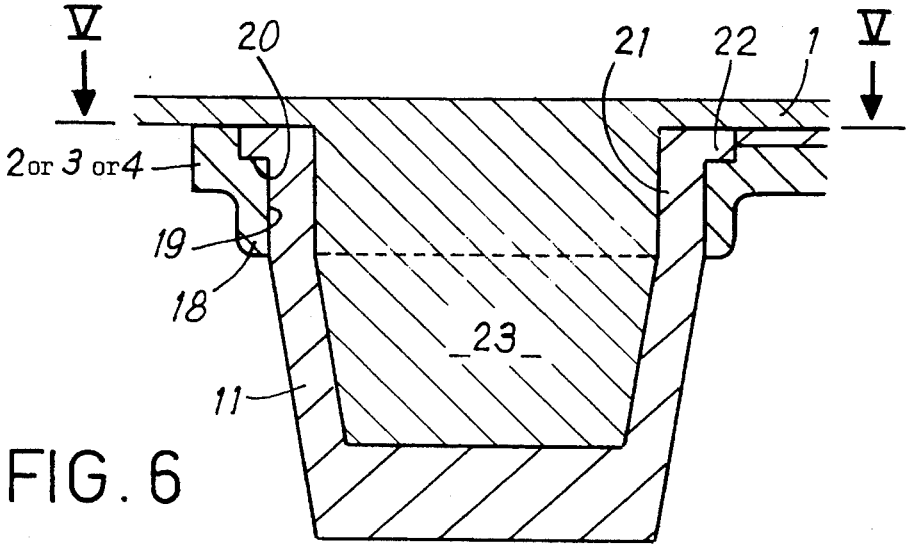
FIG. 6

OUTSOLE FOR SPORTS SHOES

RELATED PATENT APPLICATIONS

This is a continuation of U.S. application Ser. No. 07/947,932, filed Sep. 21, 1992, now abandoned.

FIELD OF THE INVENTION

The present invention relates to an outsole with projections such as molded or screwed studs, spikes, serrations or similar, for sports shoes.

BACKGROUND OF THE INVENTION

Certain sports, such as football, rugby, American football, cricket, baseball, golf athletics, etc., require shoes of which the soles include projections. Such projections, which may be more or less aggressive: spikes, studs, serrations . . ., enable the player to move faster over loose or slippery surfaces (lawns, hard courts, carpets, etc.).

Said projections are subject to much wear. Consequently they must be either interchangeable, or wear-resistant and be integral with the outsole.

Whatever the solution chosen, the presence of the projections creates a feeling of discomfort in that, since the weight of the body is distributed over some of the projections only, the sole of the foot receives, by reaction, high pressures in those parts where said projections are situated. This causes painful feelings which can be overcome by producing the outsole in a very rigid material, yet this opposes the bending of the foot and makes the shoe considerably heavier.

It is therefore the object of the present invention to provide an outsole which no longer causes pains to the sole of the wearer's foot during sports, and which, in addition to comfort, exhibits many other advantageous properties, such as:

efficiency on loose, slippery, abrasive or other surfaces, rigidity and suppleness depending on the areas, resistance to abrasion, resistance to repeated bendings in all temperatures, dampening of shocks and vibrations, lightness easy bonding under the upper, low and competitive cost.

Given that no material of natural or synthetic origin can, on its own, combine as many properties, it is necessary, for producing the outsole, to use several types of materials.

But there are only few materials which have sufficient affinity between them to be bonded directly together without the need for external agents such as adhesives. And moreover, the assembling of materials which are apparently incompatible risks to prove expensive.

Finally, most materials, with the exception of rubbers and elastomers, have not, in their compact form, the natural qualities of vibration phenomenon dampening. On the other hand, some materials, when in expanded form,acquire remarkable properties of dampening of shocks and other vibration phenomena.

SUMMARY OF THE INVENTION

The aim of the present invention is to take the foregoing into account and to reach this object, by improving an outsole comprising a sole body in plastic material under which projections are fixed.

The invention therefore resides:

in that stiffening plates in plastic material are provided with projections, projecting from their lower surface, and integrally molded, by their upper surface with the sole body in the instep area, in that a substantially elliptic aperture is provided in the sole body such that its major axis is situated on the bending axis of the outsole which corresponds to that of the foot in the metatarsophalangeal area, and that its center is situated a few millimeters, on the outside, from the middle of the width of the sole body taken on said bending axis, in that a dampening cushion in expanded plastic material is provided inside said aperture such that it projects under the sole body and emerges to form an inside covering on the latter, and in that two stiffening plates are substantially trapezoid-shaped and are placed on either side of the aperture, symmetrically with respect to the center of the latter.

Moreover, a heel-reinforcing plate in plastic material, optionally provided with projections, can be fixed to the sole body, extend between the instep and the heel and comprise diverging branches situated on either side of an oblong aperture provided in the sole body and widening out in the direction of the heel, a dampening cushion in expanded plastic material being also provided in said aperture.

The projections can also be integrally molded with the plates.

According to a particularly advantageous embodiment, the projections are hollow studs molded onto the corresponding plate, the studs being in an abrasion-resistant dampening material such as a thermoplastic polyurethane have a Shore D hardness substantially equal to 40, while the plates are in a rigid material, able to withstand repeated bending movements in all temperatures, such as a Blockamide polyester or polyether copolymer having a Shore D hardness at least equal to 55 and optionally reinforced with carbon or glass fibers and while, given that the melting point of the material constituting the plates is higher than that of the material constituting the studs, said material, at least, is mixed, before molding, with some of the material constituting the plates, in order to permit bonding, without migration, of said plates with said studs.

Each molded stud comprises, in order to be fitted into the corresponding plate, a shoulder part fittable into a bore with a clearance, provided in a sleeve projecting under said plate.

The hollow part of the studs is filled with the same material as that constituting the sole body.

In this embodiment, the sole body is molded onto the plates and is made in the same material as that constituting the plates.

According to a variant, the sole body is molded onto the plates and constituted of an abrasion-resistant material such as a thermoplastic polyurethane, whose Shore D hardness is substantially equal to 35, at least the material constituting the sole body being mixed with some of the material constituting the plates to allow bonding, without migration, of said sole with said plates.

Each dampening cushion is constituted by an expanded polyurethane cast in a mold, and it is provided with a side groove designed to be fitted over the edge of a sloping portion of the sole body defining the corresponding aperture, said cushion having a peripheral flap designed to be glued on said sloping portion.

BRIEF DESCRIPTION OF THE DRAWINGS

The invention will be more readily understood on reading the following description with reference to the accompanying drawings, in which:

FIGS. 3 to 5 are plan views showing a stiffening plate after each one of the three successive molding operations, FIG. 5 being a section taken along line V—V of FIG. 6, FIG. 6 is a section, taken on an enlarged scale, along line VI—VI of FIG. 5, to illustrate a molded stud.

DETAILED DESCRIPTION OF PREFERRED EMBODIMENT

Figure 1:
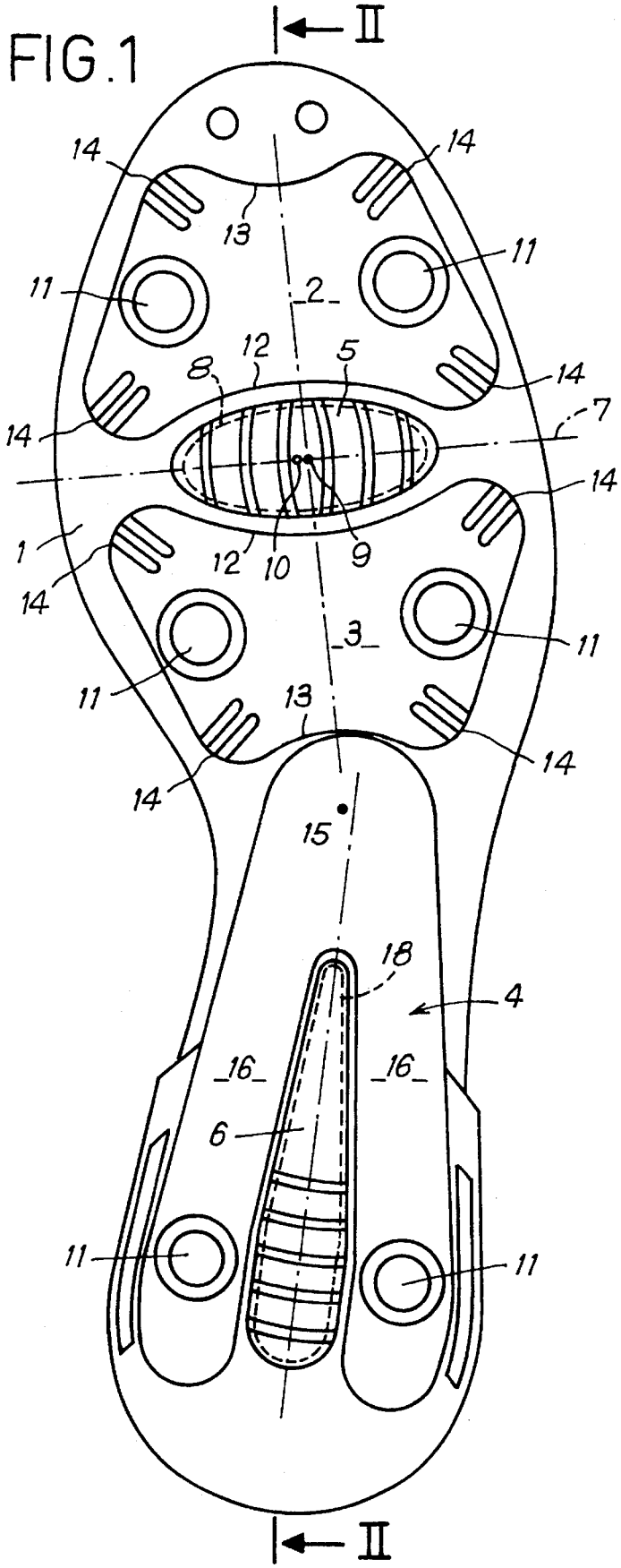
FIG. 1 is a bottom view of an outsole according to the invention.
Figure 2:
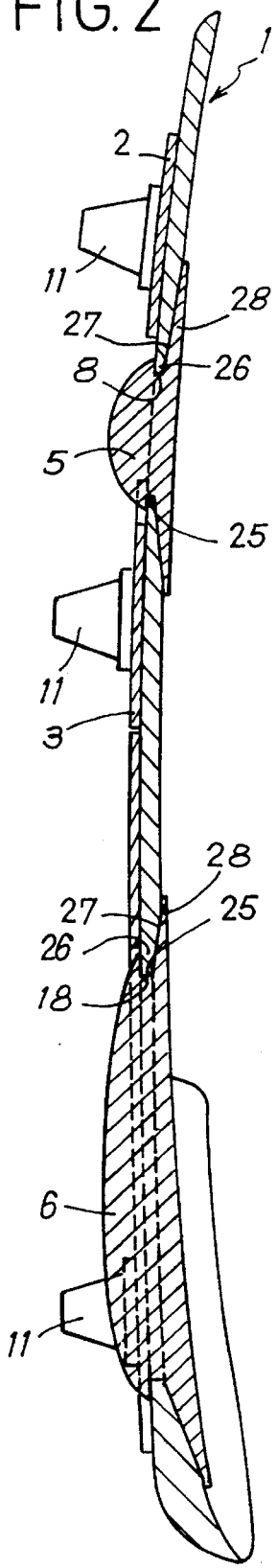
FIG. 2 is a longitudinal section along line II—II of FIG. 1.

As illustrated in FIGS. 1 and 2, the outsole comprises a sole body 1, in molded plastic material, which is defined hereinafter.

The outsole further comprises:

under the metatarsus, two identical stiffening plates 2 and 3, under the heel and the arch of the foot, a reinforcing plate 4.

Said plates are molded and constituted by a rigid material resistant to bending in all temperatures. For example, the material used can be from the family of the polyamides, one of which is sold by the company DuPont de Nemours under the name "Zitel", or from the family of the polyester elastomers one of which is sold by the same company under the name"Hytrel" or even from the family of the Blockamide polyether copolymers one of which is sold by the company Atochem under the name "Pebax series 12" or from the family of the Blockamide polyethers, one of which is sold by the company Atochem under the name "Pebax series 33". Advantageously, plates 2 to 4 are in Pebax having a Shore D strength at least equal to 55 and can be reinforced with carbon or glass fibers.

In a particularly advantageous embodiment, the sole body 1 is in the same material as the plates.

However, it may be advantageous to mold onto the sole body 1, an abrasion-resistant thermoplastic polyurethane, whose Shore D hardness is substantially equal to 35, so that it can withstand repeated bending movements.

The outsole finally comprises a front dampening cushion 5 situated between plates 2 and 3, and a rear dampening cushion 6 situated through plate 4 in the longitudinal direction. Said cushions are advantageously constituted by an expanded polyurethane cast into a mold and fixed, when solid, onto the sole body 1.

Plates 2 and 3 are substantially trapezoid-shaped. They are positioned in such a way that their contours are symmetrical with respect to the bending axis 7 of the outsole which corresponds to the axis of the metatarsophalangeal zone of the foot. Said axis is the major axis of an approximately elliptic aperture 8 formed in the sole body 1 and issuing on the inside.

Said aperture 8 is centered on a point 9 of axis 7 situated a few millimeters, say 2 for example, on the outside, from the middle 10 of the width of the sole body 1 at the level of said axis 7.

Consequently, plates 2 and 3 extend on either side of aperture 8 and are symmetrically placed, when taking into account the fact that their lower surface is provided with studs 11 and therefore must be facing down,with respect to point 9. The large base 12 of each one of plates 2 and 3 is concave and arched concentrically to aperture 8. The small base 13 of each plate is likewise concave in the illustrated example, but it could also be convex. The corners 14 of each plate are rounded.

Plates 2 and 3 being identical contour-wise, their positioning is unavoidably predetermined.

The reinforcing plate 4 is V-shaped and comprises,from a shank-forming web 15, branches 16diverging rearwardly as far as the back edge of the heel portion. Said branches extend on either side of an oblong aperture 18 formed in the sole body 1, which aperture widens out towards the heel portion and is designed to receive the rear dampening cushion 6.

Each one of plates 2 to 4 is provided with studs 11, the number and arrangement of which can vary.

Each one of plates 2 and 3 can be selected from the group of plates comprising between two and five studs 11, illustrated in FIGS. 7 to 10 respectively.

Figure 12:
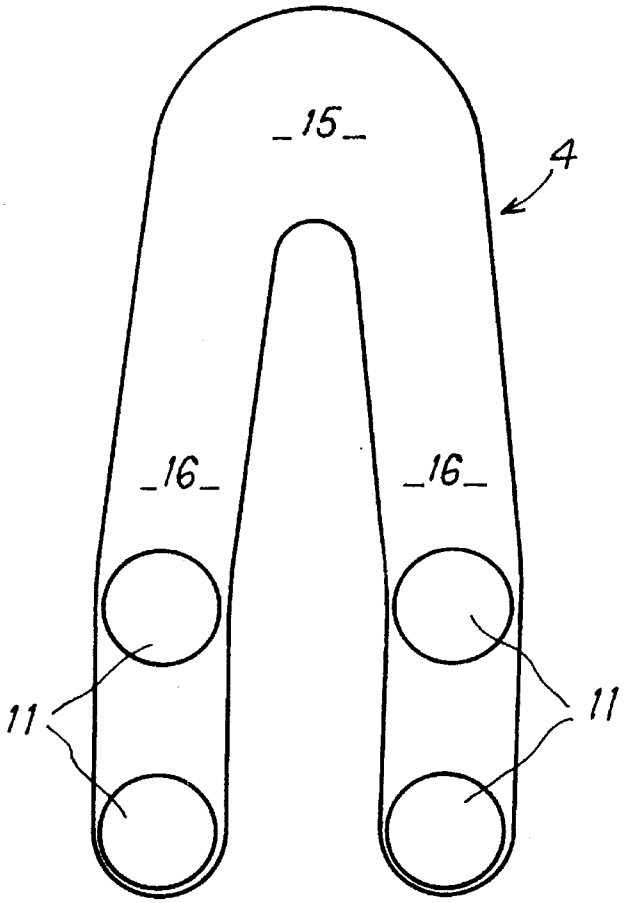
FIGS. 11 and 12 are similar views of the heel-reinforcing plate, showing two stud arrangements, said plates being able to be combined in various ways in order to produce different outsoles.
Figure 11:
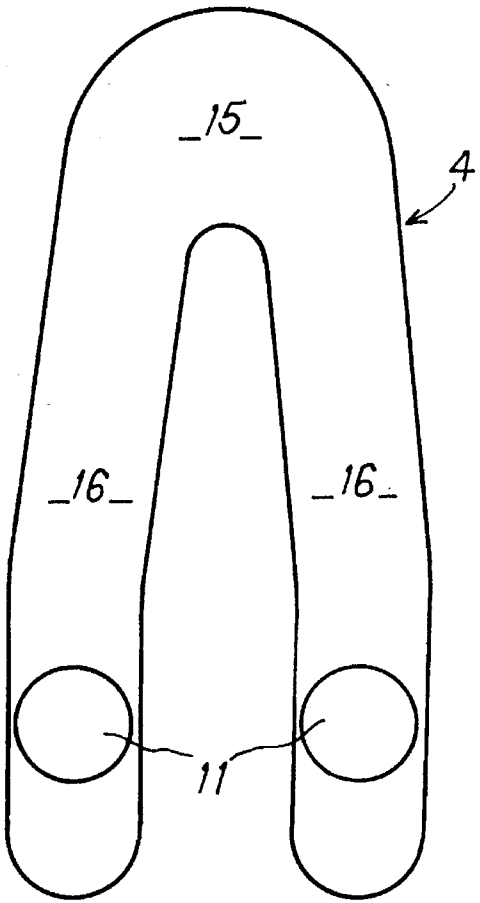

Plate 4 can also be selected from the plates illustrated in FIGS. 11 and 12, which plates comprise two and four studs respectively.

The studs 11 can be of dismountable type, in which case they cooperate with tapped bases,which are known per se and not shown, said bases being embedded in the sole body 1, their tapped hole being visible from beneath.

Said studs can also be of molded type. The embodiment illustrated in FIGS. 3 to 6 refers more particularly to this type of stud.

In any case, the circles traced in FIGS. 7 to 12 diagrammatically represent the studs,regardless of their type.

In these conditions, it is possible,by judiciously choosing the plates, to produce an outsole having between 6 and 15 molded studs, bearing in mind that, when choosing screwed studs, only small numbers of these should be used.

Figure 7:
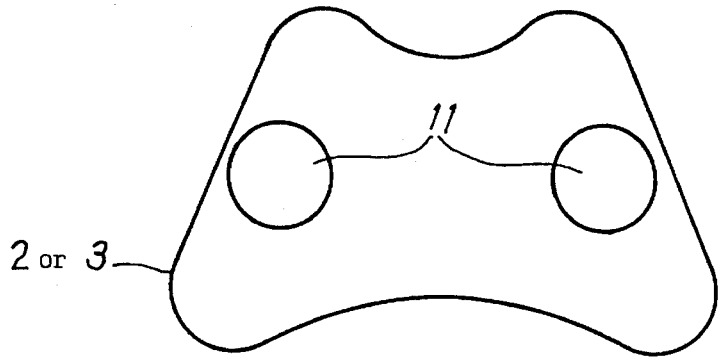
FIGS. 7 to 10 are bottom views diagrammatically showing a rigid plate with a variety of stud arrangements.
Figure 8:
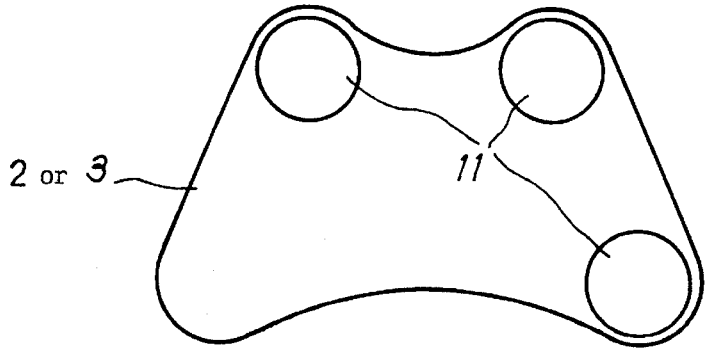
Figure 9:
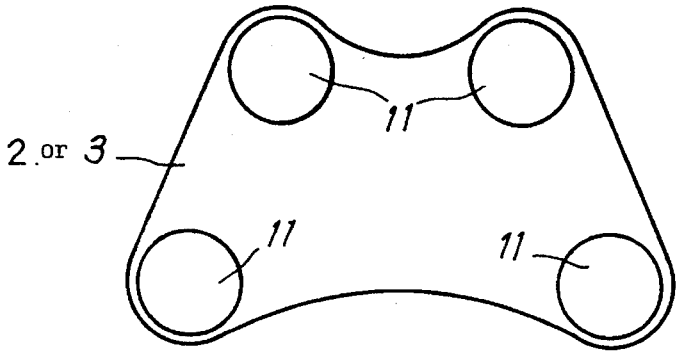
Figure 10:
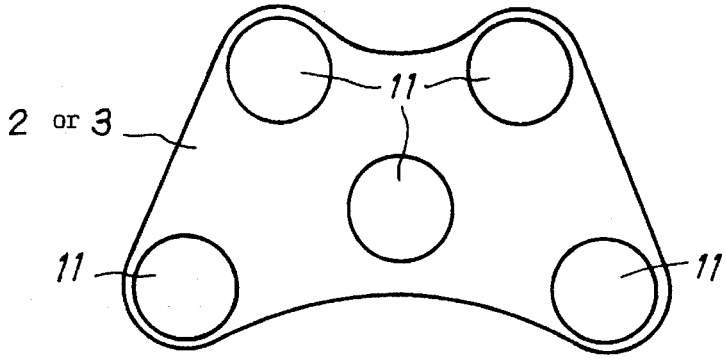

For example, an outsole with 6 studs can be produced with two plates according to FIG. 7, and with one plate according to FIG. 11, an outsole with 7 studs can be produced with one plate with two studs according to FIG. 7, placed at the front or in the middle, and one plate with three studs according to FIG. 8, placed in the middle or at the front respectively, together with one plate with two studs according to FIG. 11, an outsole with 8 studs can be produced with two plates with three studs according to FIG. 8 and one plate with two studs according to FIG. 11 or with one plate with two studs according to FIG. 7 placed at the front or in the middle and one plate with four studs according to FIG. 9 placed in the middle or at the front respectively, together with one plate with two studs according to FIG. 11, an outsole with 9 studs can be produced with one plate with two studs according to FIG. 7 placed at the front or in the middle and one plate with three studs according to FIG. 8, placed in the middle or at the front respectively, together with one plate with four studs according to FIG. 12, an outsole with 10 studs can be produced either with two plates with three studs according to FIG. 8, or with one plate with four studs according to FIG. 9 placed at the front or in the middle and one plate with two studs according to FIG. 7 placed in the middle or at the front respectively, together with one plate with four studs according to FIG. 12 in all three cases, an outsole with 11 studs can be produced with either one plate with three studs according to FIG. 8 placed at the front or in the middle and one plate with four studs according to FIG. 9 placed in the middle and at the front respectively, or with one plate with two studs according to FIG. 7 placed at the front or in the middle and one plate with five studs according to FIG. 10placed in the middle and at the front respectively, together with one plate with four studs according to FIG. 12 in all four cases, an outsole with 12 studs can be produced either with two plates with four studs according to FIG. 9, or with one plate with three studs according to FIG. 8 placed at the front or in the middle and one plate with five studs according to FIG. 10 placed in the middle and at the front respectively, together with a plate with four studs according to FIG. 12 in all three cases, an outsole with 13 studs can be produced with one plate with four studs according to FIG. 9 placed at the front or in the middle and one plate with five studs according to FIG. 10 placed in the middle and at the front respectively, together with one plate with four studs according to FIG. 12, an outsole with 14 studs can be produced with two plates with five studs according to FIG. 10 and one plate with four studs according to FIG. 12.

In other words, in those various embodiments, the studs are arranged, from the front towards the back, as follows:

for 6: 2-2-2 for 7: 2-3-2; 3-2-2 for 8: 3-3-2; 2-4-2; 4-2-2 for 9: 2-3-4; 3-2-4 for 10: 3-3-4; 2-4-4; 4-2-4 for 11: 3-4-4; 4-3-4; 2-5-4; 5-2-4 for 12: 4-4-4; 3-5-4; 5-3-4 for 13: 4-5-4; 5-4-4 for 14: 5-5-4.

Figure 13:
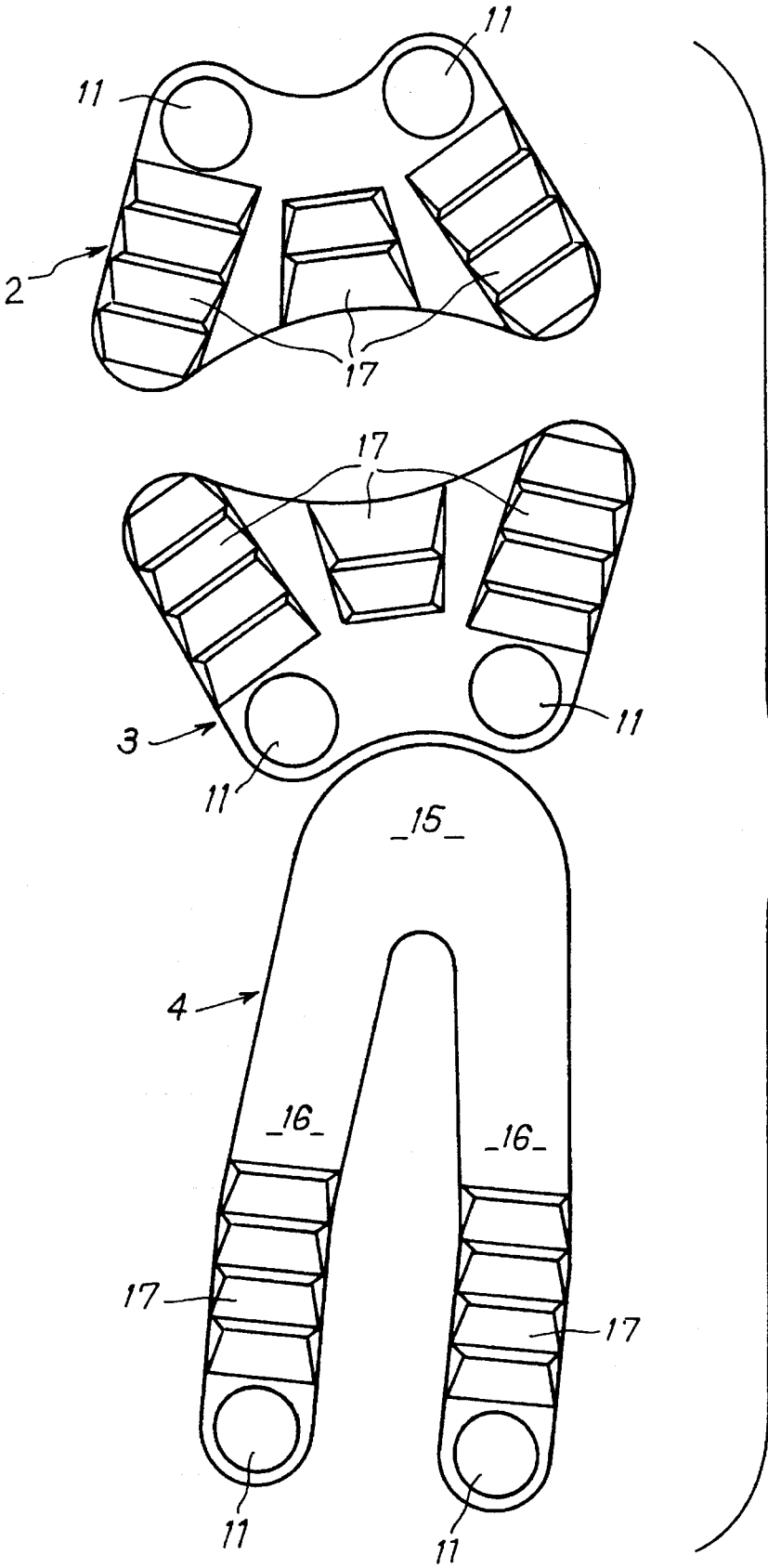
FIG. 13 is a bottom view of the three plates of the outsole, showing the combination of studs with serrations.

According to FIG. 13, plates 2 to 4 can be provided with lateral and/or median serrations 17. Said serrations can be molded integrally with the plates if they are required to be rigid, or they can be molded onto the plates as described hereinafter for studs 11 with reference to FIGS. 3 to 6, if they are required to act as dampers.

FIGS. 3 to 6 illustrate a special embodiment of a plate 2, 3 or 4 with studs 11 of molded type.

For each stud, the plate comprises a sleeve 18, integrally molded therewith, which sleeve projects downwardly and has a bore 19 issuing at the top into an annular clearance 20. Said sleeve permits mechanical embedding of the corresponding stud 11 which is provided with a substantially cylindrical base 21 extended by a shoulder 22 which is adaptable in the bore 19 and in the clearance 20, respectively. The stud 11 is hollow and thus contains a core 23 forming an integral part therewith.

The stud 11 is constituted by an abrasion-resistant dampening material such as a thermoplastic polyurethane having a Shore D hardness approximately equal to 40.

The hard core 23 is constituted by the same material as that of the sole body 1 and is molded onto the plates 2 to 4.

A difficulty arises, when assembling the various components of the outsole, to ensure that they are firmly bonded together, this difficulty being due to the incompatibility of the materials. FIGS. 3 to 5 illustrate the method used to this effect.

The plates 2 to 4 are molded with a first injection of Pebax, the cavities of the first mold being interconnected by runners (FIG. 3). Said plates being thus molded under pressure present radiating distribution channels 24 leading to the cavities provided in said plates for the studs and to the edge thereof for the second injection.

The hollow studs 11 are obtained by this second injection of polyurethane (FIG. 4). In order for said studs to be bonded to the plates, the polyurethane is mixed with Pebax, the latter being used in a proportion varying between 5% and 95% of the total weight of the melting. In this way, bonding is achieved at interface level, without migration of the polyurethane into the Pebax. This effect is surprising considering that the melting of the Pebax is around 230° C., while that of the polyurethane is around 200° C. This particularly advantageous result seems to be due to said mixture, as well as to the increase of the melting point of the polyurethane caused by the injection pressure.

In a third injection,the sole body 1 and the cores 23 are integrally molded. If this injection is made with Pebax, the Pebax is advantageously mixed with polyurethane in order to ensure efficient bonding of the studs, the bonding with plates of similar nature not requiring such an addition of polyurethane, the polyurethane being mixed with the Pebax by weight in the proportion of between 5 and 30% of the total weight of the melting.

If the third injection is made with polyurethane, the polyurethane will be advantageously mixed with Pebax in order to ensure efficient bonding with the plates, the bonding with the studs not requiring such addition of Pebax, the Pebax being mixed with the polyurethane by weight in the proportion of between 5 and 30% of the total weight of the melting.

An outsole is thus obtained to which the dampening cushions 5 and 6 have to be added.

Said cushions 5 and 6 are housed in the apertures 8 and 18. Each cushion has a side groove 25 designed to be fitted by elastic deformation over the edge 26 of a sloping portion 27 defining the corresponding aperture and widening out towards the top. In addition, each cushion has a peripheral flap 28 designed to rest on the top of the outsole and to be glued thereon. In this way, the cushions project from beneath the sole body 1, traverse the corresponding aperture 8, 18 and rest by their flap 28 on the top of said body.

The outsole thus obtained is then ready to receive the upper of which the insole is glued onto said outsole.

What is claimed is:

1. An outsole for a right or left sports shoe comprising:

a flexible sole body having a front region, an instep region, a heel region, an upper surface, a lower surface, an inner side corresponding to the inner side of a foot, an outer side corresponding to the outer side of a foot, a bending axis on said front region corresponding to the bending axis of the metatarsophalangeal zone of a foot, a middle on the bending axis corresponding to the middle of the width of the sole body along the bending axis, and a first edge which defines a first aperture situated on said bending axis of said sole body and a first sloping portion of said upper surface of said sole body, a first stiffening plate formed from plastic material,having an upper surface and a lower surface, being integrally molded with said sole body and being disposed in said front region thereof, on a first side of said bending axis, a second stiffening plate formed from plastic material, having an upper surface and a lower surface, being integrally molded with said sole body and being disposed in said front region thereof, on a second side of said bending axis, said first and second stiffening plates comprising a rigid material able to withstand repeated bending movements in all temperatures and have a Shore D hardness at least equal to 55 and being provided with sleeves, including a bore having an enlarged part, projecting under the stiffening plates, at least a first ground-engaging front projection integrally molded with, and projecting downwards from, said lower surface of said first stiffening plate, at least a second ground-engaging front projection integrally molded with, and projecting downwards from, said lower surface of said second stiffening plate, said first and second front projections comprising an abrasion-resistant material having a Shore D hardness substantially equal to 40, the weight of said abrasion-resistant material constituting between about 5% and 95% of the combined weight of said abrasion-resistant and rigid materials constituting each of said front projections, and being in the form of studs having a projecting part projecting through said bore downwards from said lower surface of said stiffening plates and shoulder part fittable into said enlarged part of said bore, and a first ground-engaging dampening cushion formed from expanded plastic material, provided inside said first aperture, said first dampening cushion having a first part which projects downwards under said lower surface of said sole body and a second part which covers said first sloping portion of said upper surface of said sole body, wherein said first aperture extends through the sole body, is substantially elliptic and has a major axis situated on said bending axis of the sole body and a center on said major axis, said center being located on said major axis, apart from the middle of said sole body on said bending axis thereof, towards said outer side of said sole body, and wherein said first and second stiffening plates are positioned on opposing sides of said bending axis and, the first aperture being situated between said first and second stiffening plates, symmetrically with respect to said center of said first aperture.

2. An outsole as claimed in claim 1, wherein said first and second stiffening plates are substantially trapezoid-shaped.

3. An outsole as claimed in claim 1, wherein said stiffening plates are reinforced with carbon or glass fibers.

4. An outsole as claimed in claim 1, wherein said abrasion-resistant material consists of thermoplastic polyurethane and wherein said rigid material is selected from the group of materials consisting of polyamides, polyester elastomers, and blockamide polyether copolymers.

5. An outsole as claimed in claim 1, wherein said studs further comprise an interior part defining a cavity, and wherein said outsole further comprises protruding cores integrally formed with said sole body and configured for substantially complemental engagement with said cavity within said studs.

6. An outsole as claimed in claim 1, wherein:

said abrasion-resistant material having a Shore D hardness substantially equal to 40 comprises a first abrasion-resistant material, said sole body consists essentially of a second abrasion-resistant material having a Shore D hardness substantially equal to 35, said first and second abrasion-resistant materials consisting of the same material, and the weight of said rigid material constitution between 5% and 30% of the combined weight of said second abrasion-resistant and rigid materials constituting said sole body.

7. An outsole as claimed in claim 6, wherein said first and second abrasion-resistant materials consist of thermoplastic polyurethane and wherein said rigid material is selected from the group of materials consisting of polyamides, polyester elastomers, and blockamide polyether copolymers.

8. An outsole as claimed in claim 1, wherein:

said abrasion-resistant material have a Shore D hardness substantially equal to 40 comprises a first abrasion-resistant material, said sole body consists essentially of a second abrasion-resistant material having a Shore D hardness substantially equal to 35, said second abrasion-resistant material and said rigid material consisting of the same material, and the weight of said first abrasion-resistant material constituting between 5% and 30% of the combined weight of said first and second abrasion-resistant materials constituting said sole body.

9. An outsole as claimed in claim 8, wherein said first abrasion-resistant material consists of thermoplastic polyurethane and wherein said material constituting said second abrasion-resistant and rigid materials is selected from the group of materials consisting of polyamides, polyester elastomers, and blockamide polyether copolymers.

10. An outsole as claimed in claim 1, wherein said first ground-engaging dampening cushion is provided with a side groove and a peripheral flap, said side groove fitting over said first edge of said sole body and said peripheral flap being fixed to said first sloping portion of the upper surface of said sole body.

11. An outsole as claimed in claim 10, wherein said first ground-engaging dampening cushion is composed of expanded polyurethane.

12. An outsole for a right or left sports shoe, comprising:

a flexible sole body having a front region, an instep region, a heel region, an upper surface, a lower surface, an inner side corresponding to the inner side of afoot, an outer side corresponding to the outer side of a foot, a bending axis on said front region corresponding to the bending axis of the metatarsophalangeal zone of a foot, a middle on the bending axis corresponding to the middle of the width of the sole body along the bending axis, and a first edge which defines a first aperture situated on said bending axis of said sole body and a first sloping portion of said upper surface of said sole body, a first stiffening plate formed from plastic material, having an upper surface and a lower surface, being integrally molded with said sole body and being disposed in said front region thereof, on a first side of said bending axis, a second stiffening plate formed from plastic material, having an upper surface and a lower surface, being integrally molded with said sole body and being disposed in said front region thereof, on a second side of said bending axis, at least a first ground-engaging front projection projecting downwards from said lower surface of said first stiffening plate, at least a second ground-engaging front projection projecting downwards from said lower surface of said second stiffening plate, a first ground-engaging dampening cushion formed from expanded plastic material, provided inside said first aperture, said first dampening cushion having a first part which projects downwards under said lower surface of said sole body and a second part which covers said first sloping portion of said upper surface of said sole body, a heel-reinforcing plate fixed to said sole body such that said heel-reinforcing plate substantially longitudinally extends in a region covering said instep region and said heel region of said sole body, said heel-reinforcing plate having an upper surface and a lower surface, and two diverging branches respectively situated along said inner and outer sides of said sole body, the latter having a second edge which defines a second aperture and a second sloping portion of said upper surface of said sole body, said second aperture being oblong and extending between said diverging branches of said heel-reinforcing plate such that said second aperture widens out for said instep region towards said heel region of said sole body,said heel-reinforcing plate comprising a rigid material able to withstand repeated bending movements in all temperatures and having a Shore D hardness at least equal to 55 and being provided with at least one sleeve, including a bore having an enlarged part, projecting under said heel-reinforcing plate, a second dampening ground-engaging cushion formed from expanded plastic material, provided inside said second aperture, said second dampening cushion having a first part which projects downwards under said lower surface of said sole body and a second part which covers aid second sloping portion of said upper surface of said sole body,and at least a ground engaging heel projection integrally molded with, and projecting downwards from, said lower surface of said heel-reinforcing plate, said heel projection comprising an abrasion-resistant material having a Shore D hardness substantially equal to 40, the weight of said abrasion-resistant material constituting between about 5% and 95% of the combined weight of said abrasion-resistant and rigid materials constituting said heel projection, and being in the form of a stud having a projecting part projecting through said bore downwards from said lower surface of said heel-reinforcing plate and a shoulder part fittable into said enlarged part of said bore, wherein said first aperture extends through the sole body, is substantially elliptic and has a major axis situated on said bending axis of the sole body and a center on said major axis, said center being located on said major axis, apart from said middle of said sole body on said bending axis thereof, towards said outer side of said sole body, and wherein said first and second stiffening plates are positioned on opposing sides of said bending axis and, the first aperture being situated between said first and second stiffening plates, symmetrically with respect to said center of said first aperture.

13. An outsole as claimed in claim 12, wherein said heel-reinforcing plate is reinforced with carbon or glass fibers.

14. An outsole as claimed in claim 12, wherein said abrasion-resistant material consists of thermoplastic polyurethane and wherein said rigid material is selected from the group of materials consisting of polyamides, polyester elastomers, and blockamide polyether copolymers.

15. An outsole as claimed in claim 12, wherein said stud further comprises an interior part defining a cavity,and wherein said outsole further comprises at least one protruding core integrally formed with said sole body and configured for substantially complemental engagement with said cavity within said stud.

16. An outsole as claimed in claim 12, wherein:

said abrasion-resistant material having a Shore D hardness substantially equal to 40 comprises a first abrasion-resistant material, said sole body consists essentially of a second abrasion-resistant material having a Shore D hardness substantially equal to 35, said first and second abrasion-resistant materials consisting of the same material, and the weight of said rigid material constituting between 5% and 30%of the combined weight of said second abrasion-resistant and rigid materials constituting said sole body.

17. An outsole as claimed in claim 16, wherein said first and second abrasion-resistant materials consist of thermoplastic polyurethane and wherein said rigid materials is selected from the group of materials consisting of polyamides, polyester elastomers, and blockamide polyether copolymers.

18. An outsole as claimed in claim 12, wherein:

said abrasion-resistant material having a Shore D hardness substantially equal to 40 comprises a first abrasion-resistant material, said sole body consists essentially of a second abrasion-resistant material having a Shore D hardness substantially equal to 35, said second abrasion-resistant material and said rigid material consisting of the same material, and the weight of said first abrasion-resistant material constituting between 5%and 30% of the combined weight of said first and second abrasion-resistant materials constituting said sole body.

19. An outsole as claimed in claim 18, wherein said first abrasion-resistant material consists of thermoplastic polyurethane and wherein said material constituting said second abrasion-resistant and rigid materials is selected from the group of materials consisting of polyamides, polyester elastomers, and blockamide polyether copolymers.

20. An outsole as claimed in claim 12, wherein:

said sole body consists essentially of an abrasion-resistant material having a Shore D hardness substantially equal to 35, the weight of said rigid material constituting between 5% and 30% of the combined weight of said abrasion-resistant and rigid materials constituting said sole body.

21. An outsole as claimed in claim 20, wherein said abrasion-resistant material consists of thermoplastic polyurethane and wherein said rigid material is selected from the group of materials consisting of polyamides, polyester elastomers, and blockamide polyether copolymers.

22. An outsole as claimed in claim 12, wherein said second ground-engaging dampening cushion is provided with a side groove and a peripheral flap, said side groove fitting over said second edge of said sole body and said peripheral flap being fixed to said second sloping portion of the upper surface of said sole body.

23. An outsole as claimed in claim 22, wherein said second ground-engaging dampening cushion is composed of expanded polyurethane.

* * * * *